US005086592A

United States Patent [19]

Schreiber

[11] Patent Number: 5,086,592

[45] Date of Patent: Feb. 11, 1992

[54] GRINDING TOOL AND METHOD OF USING SAME

[75] Inventor: Jürgen Schreiber, Wetzlar, Fed. Rep. of Germany

[73] Assignee: Buderus Schleiftechnik GmbH, Ehringshausen, Fed. Rep. of Germany

[21] Appl. No.: 624,211

[22] Filed: Dec. 4, 1990

Related U.S. Application Data

[63] Continuation-in-part of Ser. No. 415,406, Sep. 29, 1989, abandoned, which is a continuation of Ser. No. 249,703, Sep. 27, 1988, abandoned.

[30] Foreign Application Priority Data

Oct. 2, 1987 [DE] Fed. Rep. of Germany ..... 3733308

[51] Int. Cl.[5] ..... B24B 1/00

[52] U.S. Cl. ..... 51/291; 51/73 R; 51/105 SP; 51/206 R; 51/281 P; 51/327

[58] Field of Search ..... 51/105 LG, 181 R, 181 WT, 51/281 P, 290, 291, 326, 327, 3, 33 R, 33 W, 55, 58, 73 R, 105 SP, 206 R, 241 VS, 241 A, 72 R, 103 R

[56] References Cited

U.S. PATENT DOCUMENTS

| | | | |
|---|---|---|---|
| 1,352,790 | 9/1920 | Danielsson | 51/290 |
| 3,353,303 | 11/1967 | Stern . | |
| 3,631,898 | 1/1972 | Harley | 51/327 |
| 3,822,516 | 7/1974 | Huber | 51/326 |
| 3,881,889 | 5/1975 | Hunkeler | 51/288 |
| 4,180,947 | 1/1980 | Schmidt | 51/326 |
| 4,587,763 | 5/1986 | Hahn | 51/290 |
| 4,592,172 | 6/1986 | Egusa et al. | 51/291 |

*Primary Examiner*—James G. Smith
*Assistant Examiner*—Jack Lavinder
*Attorney, Agent, or Firm*—Herbert Dubno; Andrew Wilford

[57] ABSTRACT

A grinding tool adapted to be mounted on an end of an arbor and rotated thereby about an axis in contact with a workpiece is unitarily formed with a head and a foot. The head has a frustoconical front end face centered on the axis, turned away from the arbor, and tapering away from the arbor. It also has a frustoconical back face centered on the axis, turned toward the arbor, meeting the front face at an outer circular edge centered on the axis, tapering toward the arbor, and forming with the front face an acute angle. The foot has a frustoconical outer surface centered on the axis, meeting the back face at a front inner circular edge centered on the axis, tapering toward the front edge, and forming a right angle with the back face. The front and back faces of the head meet at the outer edge at an angle of about 45°.

1 Claim, 3 Drawing Sheets

GRINDING TOOL AND METHOD OF USING SAME

CROSS REFERENCE TO RELATED APPLICATIONS

This application is a continuation-in-part of my copending patent application 07/415,406 filed 29 Sept. 1989, now abandoned as a continuation of now abandoned patent application Ser. No. 07/249,702 itself filed 27 Sept. 1988 with a claim to a German priority date of 02 Oct. 1987.

FIELD OF THE INVENTION

The present invention relates to a grinding stone or tool. More particularly this invention concerns such a tool adapted to grind surfaces of revolution and a method of using such a tool.

BACKGROUND OF THE INVENTION

In European open patent application 00 51 136 a grinding machine is described with which several grinding processes can be performed simultaneously. For each different grinding process however a corresponding grinding tool with its own grinding unit is required. The greater the number of different grinding operations which must be performed on a workpiece, the greater must be the number of grinding tools which must be provided with this grinding machine.

In U.S. Pat. No. 4,587,763 of Hahn a tool machines the front face of the workpiece, that is the face directed toward the motor that drives the tool, and the inside face simultaneously. The tool does not project through the annular workpiece and machine its opposite face and, in fact, this would be impossible because the workpiece is resting on its back face on a turntable.

Another problem occurs with known grinding tools, even when they are specifically shaped to fit to a workpiece. When such a workpiece wears somewhat it no longer fits correctly and digs into the workpiece, ruining it.

OBJECTS OF THE INVENTION

It is therefore an object of the present invention to provide an improved grinding tool.

Another object is the provision of such an improved grinding tool which overcomes the above-given disadvantages, that is which allows a cylindrical inner surface and a flat back surface of a workpiece to be machined simultaneously.

A further object is to provide an improved method of grinding such a workpiece with such a tool.

SUMMARY OF THE INVENTION

A grinding tool adapted to be mounted on an end of an arbor and rotated thereby about an axis in contact with a workpiece according to this invention is unitarily formed with a head and a foot. The head has a frustoconical front end face centered on the axis, turned away from the arbor, and tapering away from the arbor. It also has a frustoconical back face centered on the axis, turned toward the arbor, meeting the front face at an outer circular edge centered on the axis, tapering toward the arbor, and forming with the front face an acute angle. The foot has a frustoconical outer surface centered on the axis, meeting the back face at a front inner circular edge centered on the axis, tapering toward the front edge, and forming a right angle with the back face. The front and back faces of the head meet at the outer edge at an angle of about 45°.

In other words the outer foot surface and the back head face are each formed by a family of lines and each line of the foot surface is perpendicular to the respective line of the back head surface. This makes it possible to simultaneously finish a cylindrical inner workpiece surface and a flat end workpiece surface, even if the end workpiece surface being machined is turned away from the arbor. In this latter case of course the diameter of the heat at its outer edge must be smaller than the diameter of the passage through the workpiece. Furthermore the angle the front and back head faces meet at means that if the workpiece wears, it will continue to fit the workpiece and will not ruin it.

Thus it is possible to rotate this tool about its axis while rotating relative to the rotating tool about a workpiece axis offset from the tool axis an annular workpiece having an end face turned away from the arbor and perpendicular to the workpiece axis and a passage having a cylindrical passage surface centered on the workpiece axis. The outer foot surface is engaged radially at a line of contact with the passage surface of the workpiece for material removal while the tool axis and workpiece axis are maintained at an acute angle to each other with the workpiece axis parallel to the line of contact where the foot outer surface engages the passage surface. Meanwhile the head grinding surface is engaged axially backward against the end face of the workpiece.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
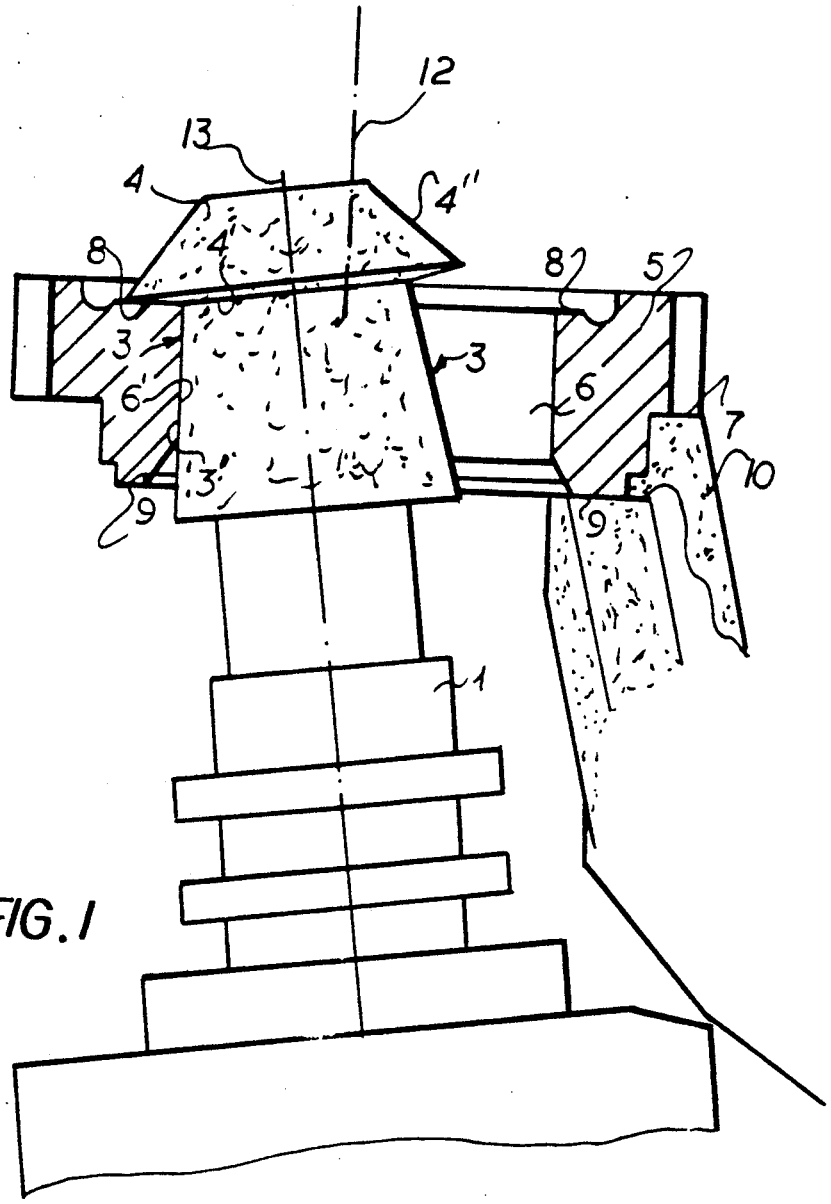
FIG. 1 is a plan view of a grinding tool according to my invention fitted to a workpiece to be ground.
Figure 2:
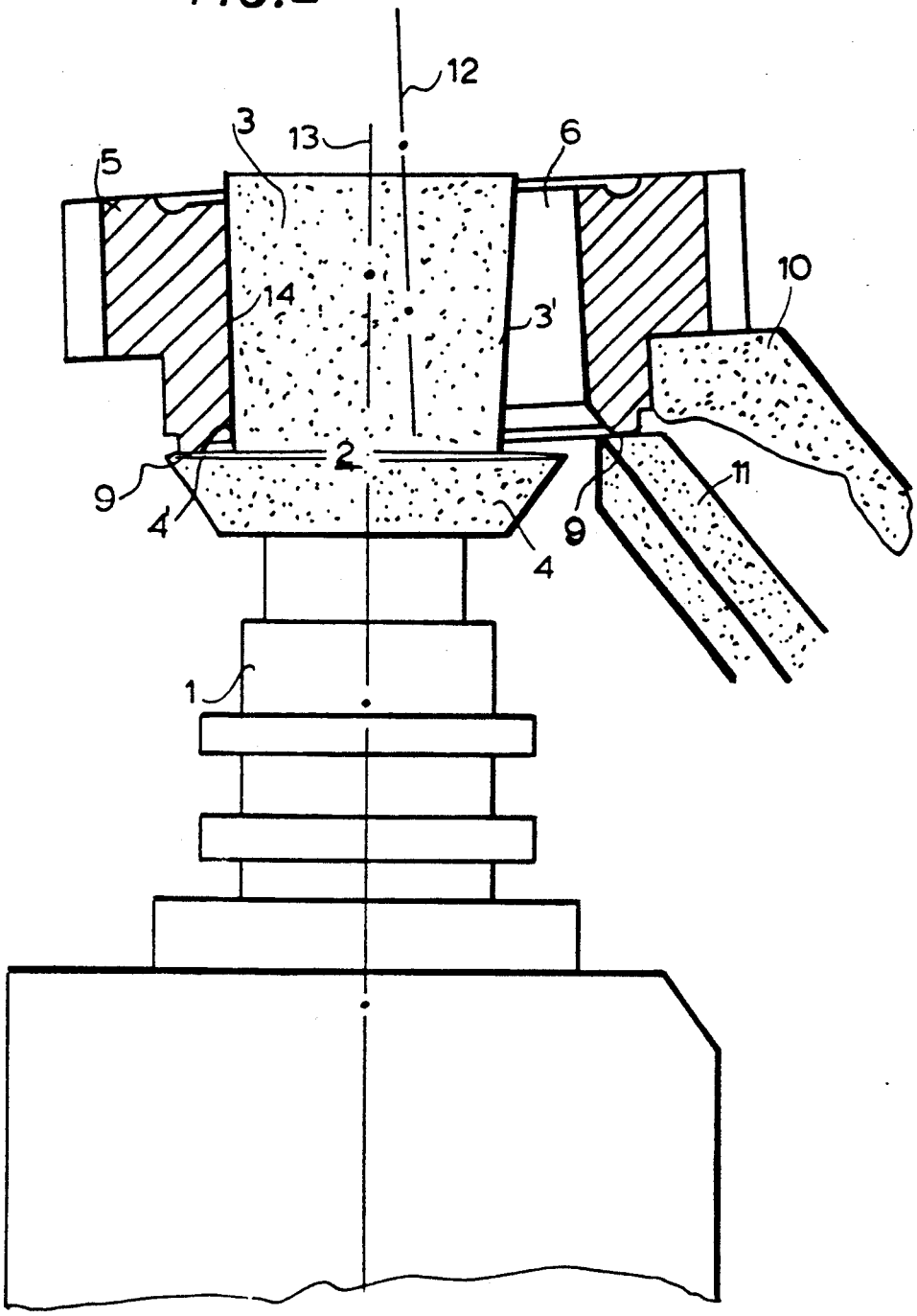
FIG. 2 is another view of a different arrangement using a grinding tool according to my invention.

As seen in FIGS. 1 and 2 the mushroom-shaped grinding tool 2 has a foot 3 and a head 4 both carried on an arbor 1 centered on and rotatable about an axis 13. A workpiece 5 is also shown having a central passage 6 that is to be ground internally on a passage surface 6' shaped as a cylinder centered on an axis 12. This workpiece 5 also has planar surfaces 7, 8 and 9 to be ground that extend perpendicular to the axis 12. While as described below the surfaces 6' and 8 are ground by the tool 2, the plane surfaces 7 and/or 9 are ground by the separate grinding tools or stones 10 and 11.

In accordance with this invention the tool 2 is unitarily formed with a head 4 having a frustoconical front end face 4'' centered on the axis 13, turned away from the arbor 1, and tapering away from the arbor 1. The head 4 also has a frustoconical back face 4' centered on the axis 13, meeting the front face 4'' at a circular edge centered on the axis 13, tapering toward the arbor 1, and forming with the front face 1'' an acute angle. The tool 2 also has a foot 3 having a frustoconical outer surface 3' centered on the axis 13, meeting the back face 4' at a circular front edge centered on the axis 13, tapering toward the front edge, and forming a right angle with the back face 4'.

Thus it is possible as shown in FIG. 1 to machine the cylindrical inner surface 6' and a planar end surface 8 of the gear 5 simultaneously. This is done by aligning the tool axis 13 at an acute angle to the passage axis 12 equal to the apex angle of the surface 3' and simultaneously bringing the surface 3' radially into contact with the surface 6' and the surface 4'' axially backwardly into contact with the surface 8. The tool 2 is rotated at high speed about its axis 13 and the workpiece 5 is simultaneously rotated about its axis 12. Meanwhile edges of the stones 10 and 11 are pressed against the surfaces 7 and 9.

A particular advantage of this FIG. 1 system is that it allows a surface 8 that is turned away from the tool arbor 1 to be ground. Normally in grinding it is impossible to grind a surface turned away from the tool.

Then as seen in FIG. 2 it is possible to invert the tool and continue grinding, simultaneously finishing the opposite end face 9 and the inner surface 6'. Thus without rechucking the workpiece it is possible to grind both its surfaces.

Figure 3:
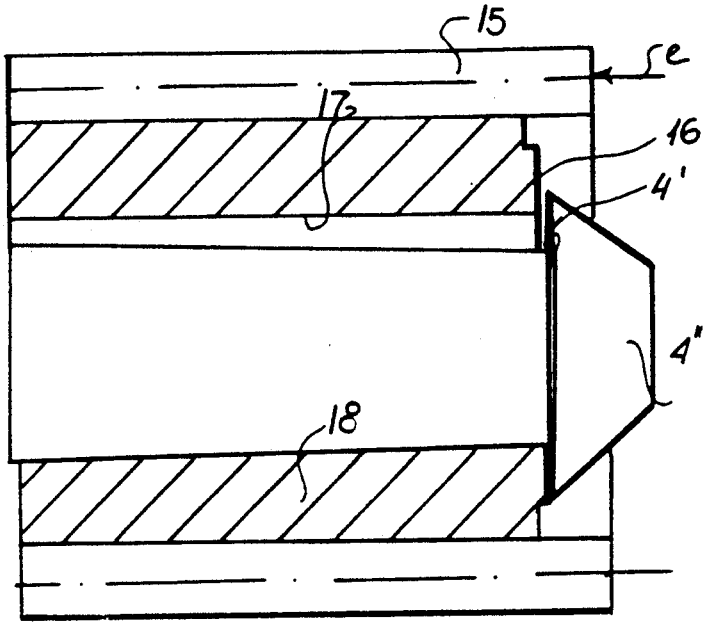
FIG. 3 is a schematic side view illustrating the tool as in FIG. 1, but grinding a lining sleeve of a ring gear.

FIG. 3 shows another system according to this invention where the tool 2 is used to grind an end face 16 of a lining sleeve 18 of a gear 15. This lining sleeve 18 is set axially somewhat in from the end gear 15 so that grinding with a tool like the stones 10 or 11 is impossible. The system of this invention does, however, permit this set-in end face 16 to be ground simultaneously with a cylindrical inner surface of the lining sleeve 16, both at the same time.

Figure 4:
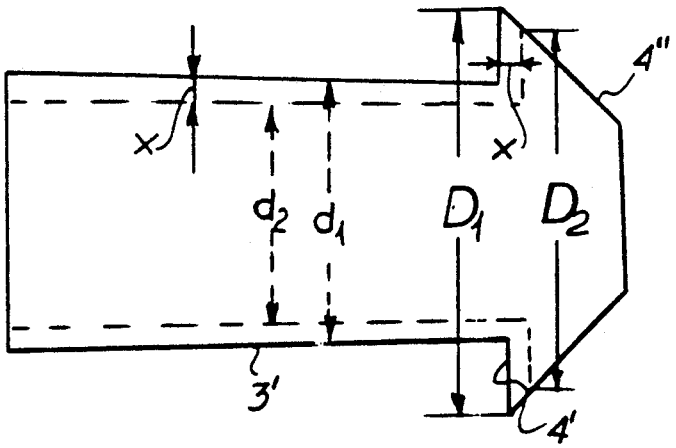
FIG. 4 is a side view illustrating principles of the present invention.

Furthermore according to this invention as illustrated in FIG. 4, with the system of this invention as the tool 2 wears it is able to continue grinding. More particularly as the outer diameter of the edge where the surfaces 4' and 4'' meet decreases from $D_1$ to $D_2$ the diameter of the side surface 3' will similarly decrease by the same differential x from $d_1$ to $d_2$. The result will be that the radial projection $D_1-d_1$ or $D_2-d_2$ of the face 4' will remain the same. The inclined outer surface 4'' causes the projection of the head 4 to decrease as it wears.

I claim:

1. A grinding process using a grinding tool, centered on an axis, adapted to be mounted on an end of an arbor, and unitarily formed with:

a head having a frustoconical front end face centered on the axis, turned away from the arbor, and tapering away from the arbor, and a frustoconical back face centered on the axis, turned toward the arbor, meeting the front face at an outer circular edge centered on the axis, tapering toward the arbor, and forming with the front face an acute angle; and a foot having a frustoconical outer surface centered on the axis, facing radially away from the axis, meeting the back face at a front inner circular edge centered on the axis, tapering toward the front edge, and forming a right angle with the back face;

the process comprising the steps of:

rotating the tool about its axis;

rotating relative to the rotating tool about a workpiece axis offset from the tool axis an annular workpiece having an end face turned away from the arbor and perpendicular to the workpiece axis and a passage having a cylindrical passage surface centered on the workpiece axis;

engaging the outer foot surface at a line of contact with the passage surface of the workpiece;

maintaining the tool axis and workpiece axis at an acute angle to each other with the workpiece axis parallel to the line of contact where the foot outer surface engages the passage surface; and engaging the frustoconical back face of the grinding tool axially backward against the end face of the workpiece.

* * * * *